US007579936B2

(12) United States Patent
Hsu et al.

(10) Patent No.: US 7,579,936 B2
(45) Date of Patent: Aug. 25, 2009

(54) CHOKE TRANSFORMER USED IN LIQUID CRYSTAL DISPLAY BACKLIGHT DRIVER

(75) Inventors: Cheng-Chia Hsu, Chupei (TW); Teng-Kang Chang, Jhudong Township, Hsinchu County (TW)

(73) Assignee: Logah Technology Corp., Hsinchu County (TW)

( * ) Notice: Subject to any disclaimer, the term of this patent is extended or adjusted under 35 U.S.C. 154(b) by 638 days.

(21) Appl. No.: 11/150,192

(22) Filed: Jun. 13, 2005

(65) Prior Publication Data

US 2006/0012558 A1 Jan. 19, 2006

(30) Foreign Application Priority Data

Jul. 16, 2004 (TW) ..... 93211233 U

(51) Int. Cl.
*H01F 17/06* (2006.01)

(52) U.S. Cl. ..... 336/178

(58) Field of Classification Search ..... 336/65, 336/83, 178, 180–184, 198, 200, 206–208, 336/220–223

See application file for complete search history.

(56) References Cited

U.S. PATENT DOCUMENTS

| | | | | |
|---|---|---|---|---|
| 6,075,431 | A * | 6/2000 | Honma | 336/180 |
| 6,154,113 | A * | 11/2000 | Murai | 336/198 |
| 6,201,463 | B1 * | 3/2001 | Yamashita et al. | 336/198 |
| 6,600,402 | B1 * | 7/2003 | LaFleur et al. | 336/61 |
| 6,771,157 | B2 * | 8/2004 | Nishikawa et al. | 336/178 |
| 6,853,284 | B2 * | 2/2005 | Nagai et al. | 336/83 |
| 6,958,673 | B2 * | 10/2005 | Suzuki | 336/208 |

* cited by examiner

*Primary Examiner*—Tuyen Nguyen
(74) *Attorney, Agent, or Firm*—Rosenberg, Klein & Lee

(57) ABSTRACT

Disclosed is a choke transformer used in liquid crystal display (LCD) backlight driver, comprising a winding base on which a plurality of spacers are formed and having a hollow structure, a core received within the winding base and a plurality of windings wound between two neighboring ones of the plurality of spacers as a winding set, each winding set having windings of different characteristics; and is characterized in that an air gap is provided between the winding base having the hollow structure and the core. With such devised choke transformer, a higher endurable voltage is achieved. Further, the characteristics of prolonged lifetime, reduced cost, smaller dimension and saved installation space may be achieved with the choke transformer.

2 Claims, 6 Drawing Sheets

CHOKE TRANSFORMER USED IN LIQUID CRYSTAL DISPLAY BACKLIGHT DRIVER

BACKGROUND OF THE INVENTION

1. Field of the Invention

The present invention relates to a choke transformer used in liquid crystal display (LCD) backlight driver. More particularly, the present invention relates to a choke transformer used in LCD backlight driver, in which a winding base is devised in structure so that an air gap is provided between the winding base and the core, through which the choke transformer may have a higher endurable voltage.

2. Description of the Prior Art

Referring now to FIG. 1, a cross sectional view of a transformer used in a conventional liquid crystal display (LCD) backlight driver is depicted therein. As shown, the transformer 1 is composed of a winding base 11, a core 12 and a plurality of windings 13. On the winding base 11, a plurality of spacers 111 are formed. Between two neighboring one of such spacers 111, a portion of the plurality of windings 13 of different characteristics are wound. In the winding base 11, there is a hollow structure within which the core 12 is centrally provided. At a conjunction where the winding base 11 and the core 12 joint, the winding base 11 and the core 12 may not achieve a total planar contact and thus between contact surfaces of the winding base 11 and the core 12 is a very small and non-uniform air gap. For an air gap of 0.003~0.02 mm, only a voltage lower than 300V (measured in $V_{rms}$) may be endured, as shown in Table 1. When the supplied voltage becomes higher and higher, the windings may have charges discharged towards the core 12, leading to ionization of the air and thus arc light taken place. At this time, the transformer 1 fails to work in a normal manner.

TABLE 1

Relationship between breakage voltage of air and distance

| Distance (mm) | Breakdown Voltage ($V_{rms}$) |
|---|---|
| 1 | 3000 |
| 0.5 | 2000 |
| 0.35 | 1500 |
| 0.2 | 1000 |
| 0.02 | 300 |
| 0.01 | 250 |
| 0.003 | 300 |

From the above description and Table 1, it can be readily known that such conventional transformer is inherent with some drawbacks and needs to be addressed and improved.

In view of these problems encountered in the prior art, the Inventors have paid many efforts in the related research and finally developed successfully a choke transformer used in LC backlight driver, which is taken as the present invention.

SUMMARY OF THE INVENTION

It is, therefore, an object to provide a choke transformer used in liquid crystal display (LCD) backlight driver, in which there is an air gap fixed between a winding base and a core and a higher breakdown voltage may be achieved with presence of the smaller winding base and the air gap, compared with that achieved in the prior art.

The choke transformer used in LCD backlight driver according to the present invention comprises a winding base having a hollow structure and on which a plurality of spacers are formed, a core centrally received within the hollow structure of the winding base and a portion of the plurality of windings wound between two neighboring ones of the plurality spacers as a winding set within the two neighboring spacers, each winding set having windings of different characteristics, and is characterized in that an air gap is provided between the winding base having the hollow structure and the core. With such devised choke transformer, a higher endurable voltage is achieved. Further, the choke transformer has the characteristics of prolonged lifetime, reduced cost, smaller dimension and saved installation space. For a specification of breakdown voltage of $1200V_{rms}$, a mere 0.3 mm thick winding base along with a thickness of 0.2 mm of the air gap may be enough, compared with 0.9 mm of the winding base in the prior art. Consequently, amount and thus cost of winding base and windings used in the present invention may be reduced provided that a same endurable voltage as that in the prior art is to be achieved. In another sense, a higher endurable voltage may be created in the present invention on condition that a same dimension of the transformer as that in the prior art is taken.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
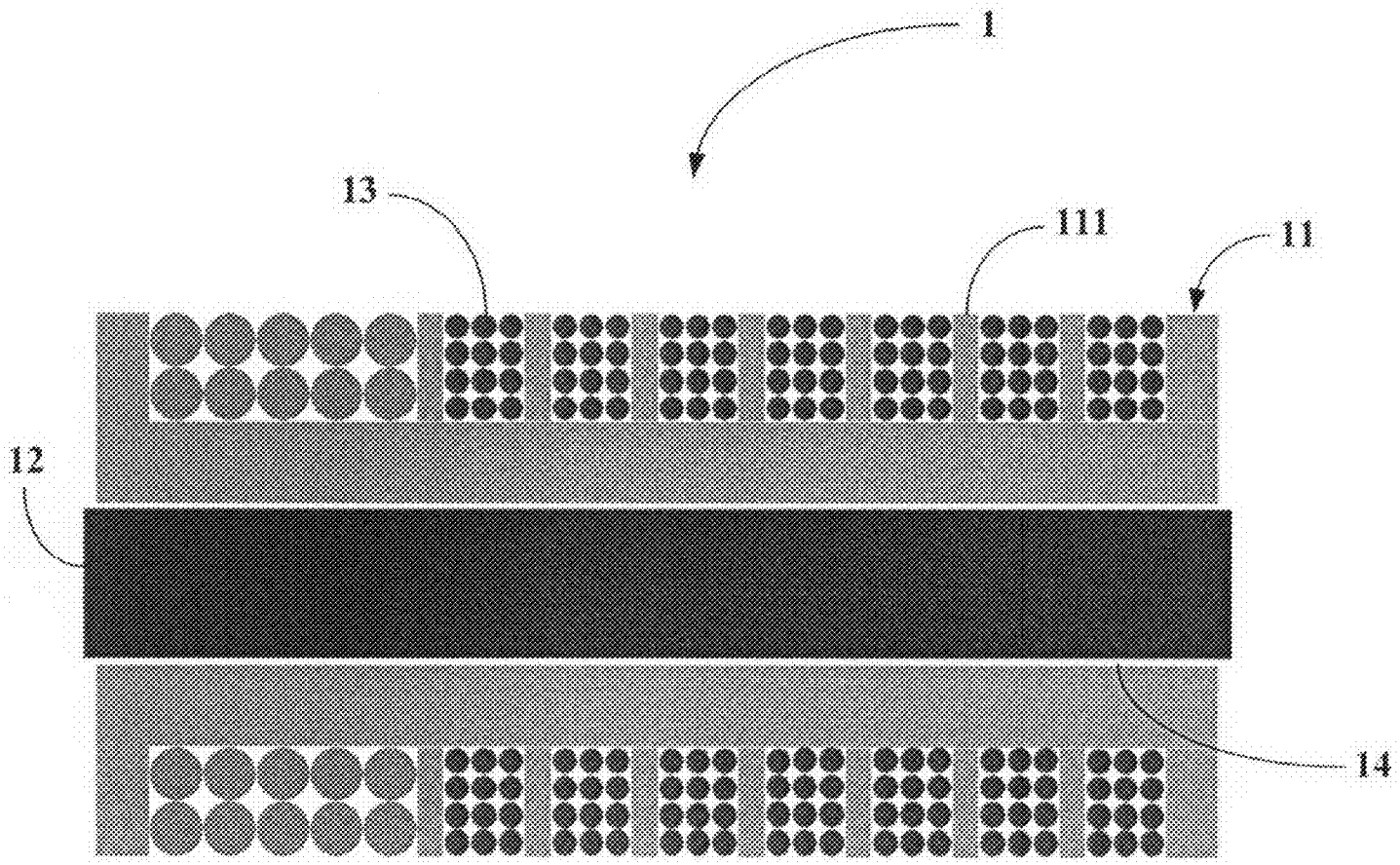
PRIOR ART FIG.1
FIG. 1 is a cross sectional view of a conventional transformer used in liquid crystal display (LCD) backlight driver.
Figure 2:
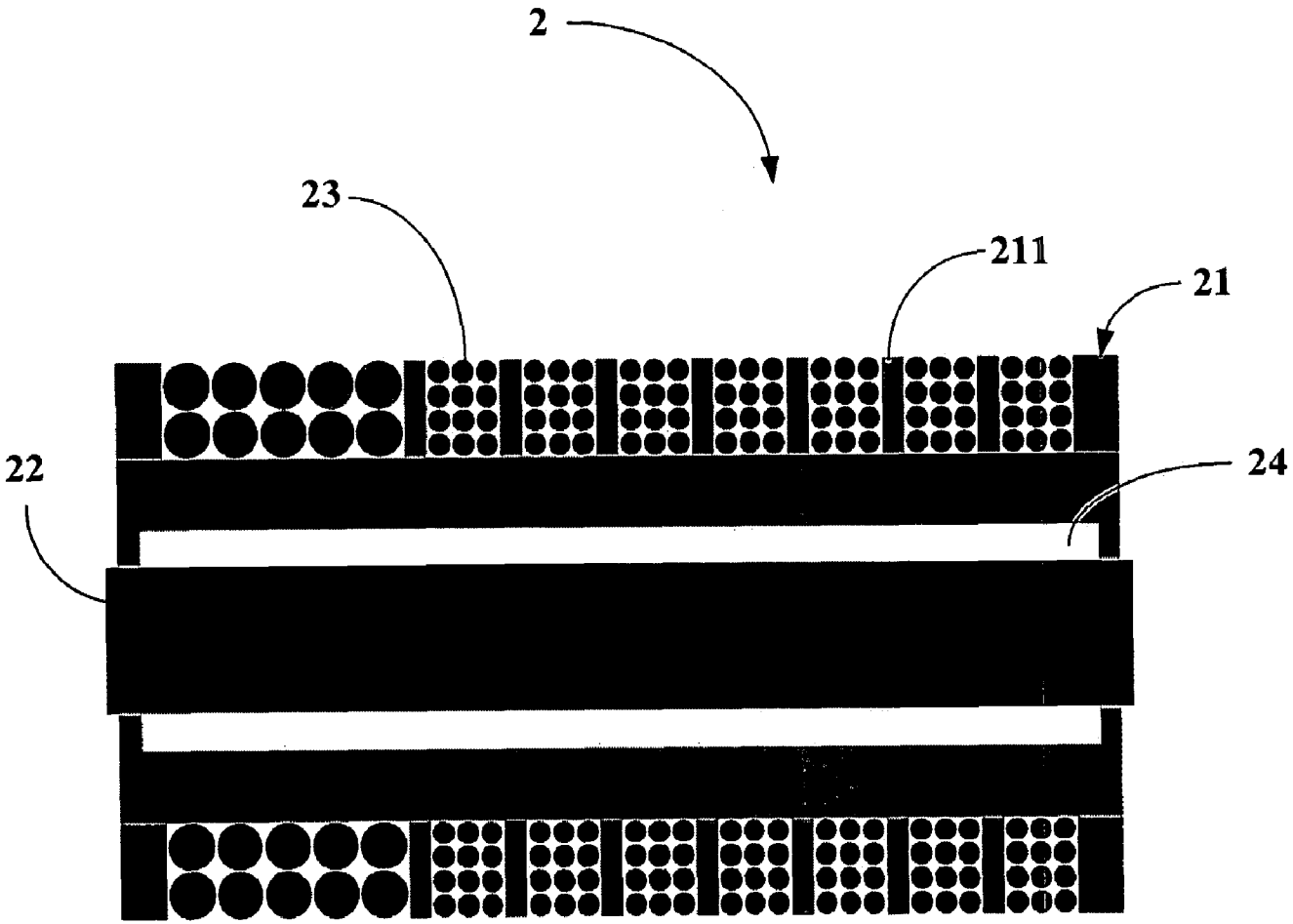
FIG. 2 is a cross sectional view of a choke transformer used in LCD backlight driver according to a first embodiment of the present invention.

Referring to FIG. 2, a cross sectional view of a choke transformer used in liquid crystal display (LCD) backlight driver according to a first embodiment of the present invention is depicted therein. As shown, the choke transformer 2 is composed of a winding base 21, a core 22 and a plurality of windings 23. On the winding base 21, a plurality of spacers 211 are formed. Between two neighboring ones of the plurality of spacers 211, a portion of the plurality of windings 23 of different characteristics are wound as a winding set. The winding base 21 has a hollow structure therein and the core 22 is received within the hollow structure. A long air gap 24 is provided between the winding base 21 and the core 22. As such, the choke transformer 2 endurable to a high voltage is formed.

Figure 3:
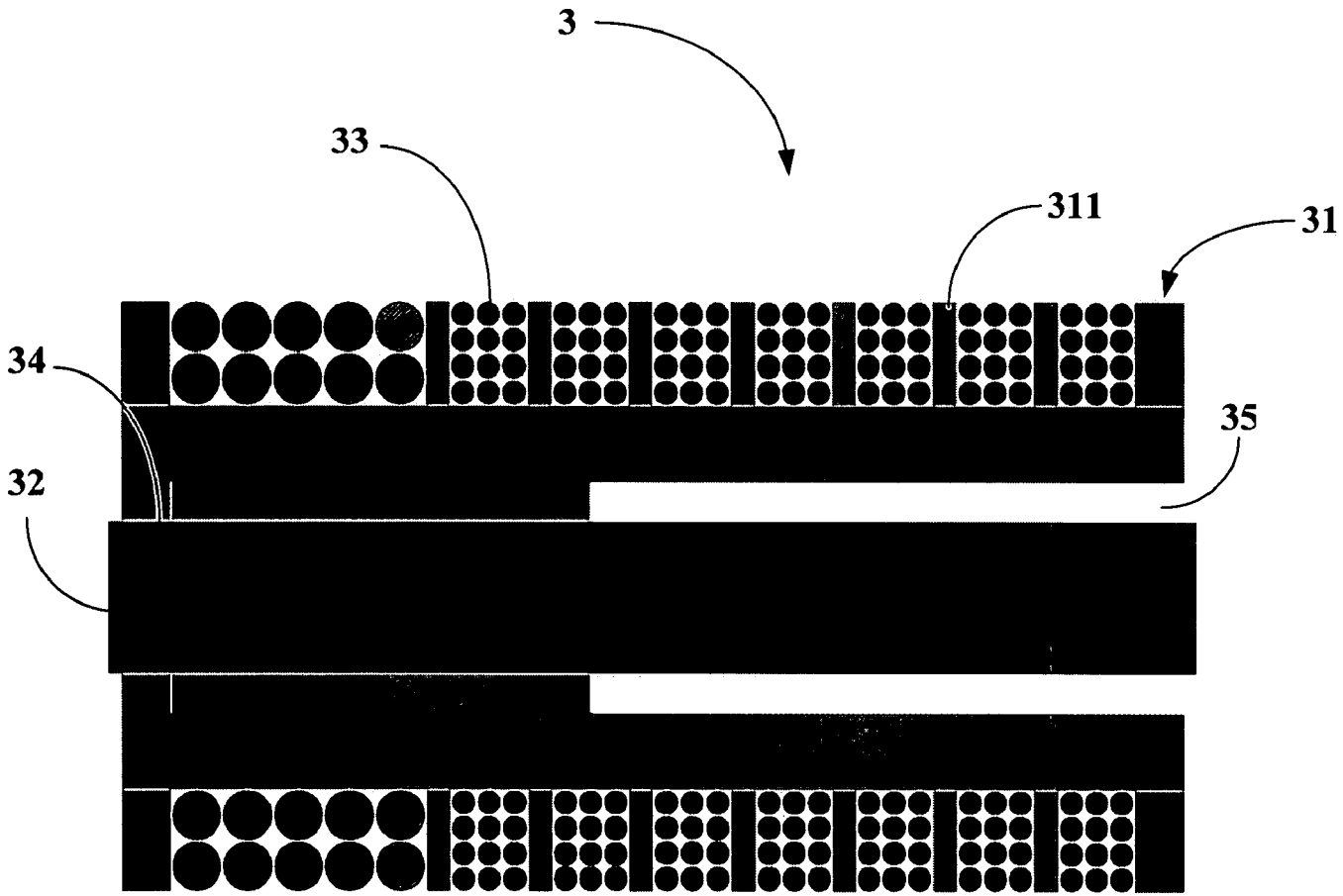
FIG. 3 is a cross sectional view of the choke transformer used in LCD backlight driver according to a second embodiment of the present invention.

Referring to FIG. 3, a cross sectional view of the choke transformer used in LCD backlight driver according to a second embodiment of the present invention is depicted therein. As shown, the choke transformer 3 is composed of a winding base 31, a core 32 and a plurality of windings 33. On the winding base 31, a plurality of spacers 311 are formed.

Between two neighboring one of the plurality of spacers 311, a portion of the plurality of windings 33 of different characteristics are wound as a winding set. The winding base 31 has a hollow structure therein and the core 32 is centrally received in the hollow structure, the hollow structure being a two-section-in-connection structure with a front section thereof narrower while a rear section thereof wider. In this configuration, two long air gaps 34, 35 of different widths in connection are provided between the winding base 31 and the core 32. As such, the choke transformer 3 endurable to a high voltage is formed.

Figure 4:
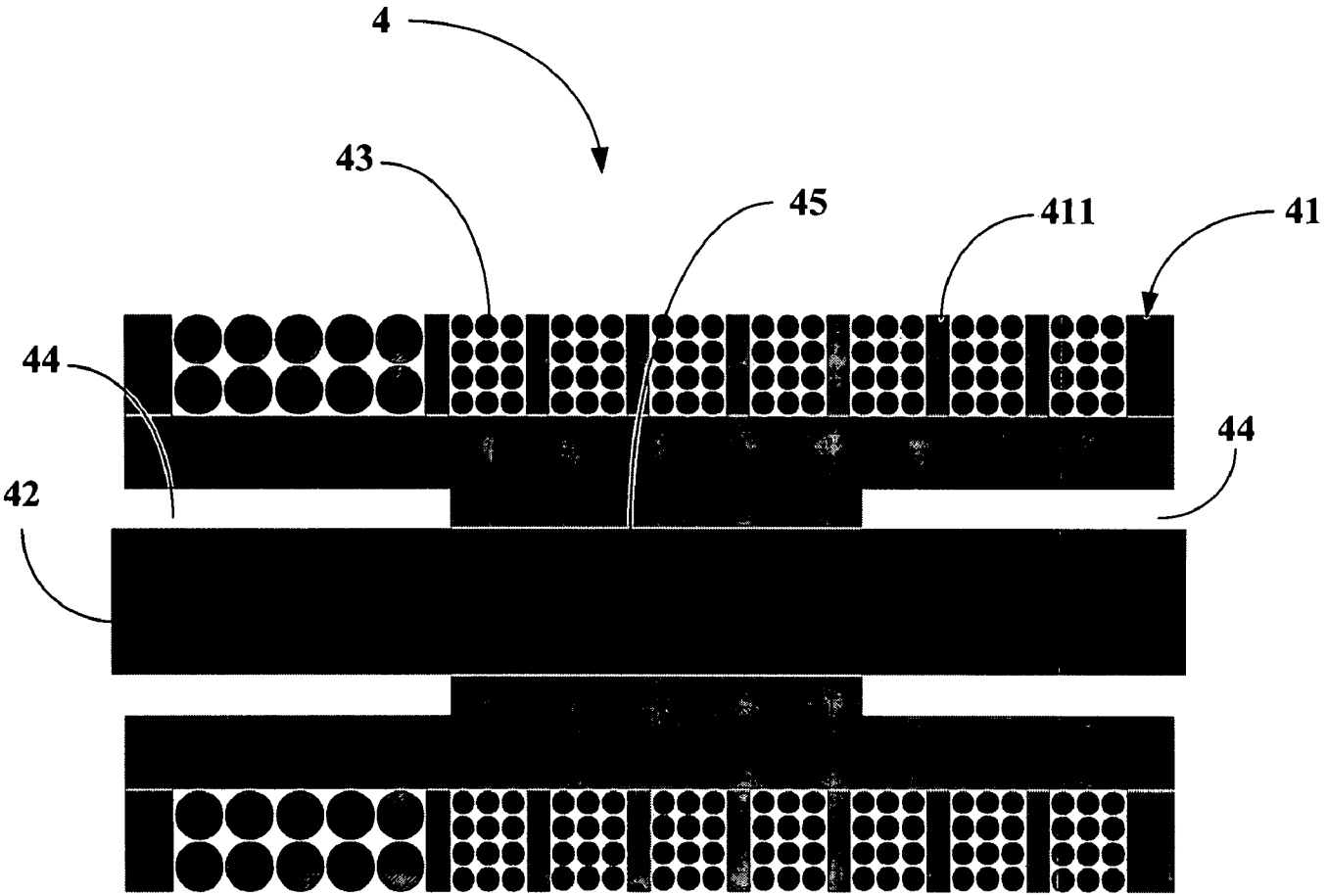
FIG. 4 is a cross sectional view of the choke transformer used in LCD backlight driver according to a third embodiment of the present invention.

Referring to FIG. 4, a cross sectional view of the choke transformer used in LCD backlight driver according to a third embodiment of the present invention is depicted therein. As shown, the choke transformer 4 is composed of a winding base 41, a core 42 and a plurality of windings 43. On the winding base 41, a plurality of spacers 411 are formed. Between two neighboring one of the plurality of spacers 411, a portion of the plurality of windings 43 of different characteristics are wound. The winding base 41 has a hollow structure therein and the core 42 is centrally received in the hollow structure, the hollow structure having two hollow portions at two ends and a center portion, respectively, with the portions at the two sides wider while the center portion narrower. In this configuration, two air gaps 44, 45 of different widths in connection are provided between the winding base 41 and the core 42. As such, the choke transformer 4 endurable to a high voltage is formed.

Figure 5:
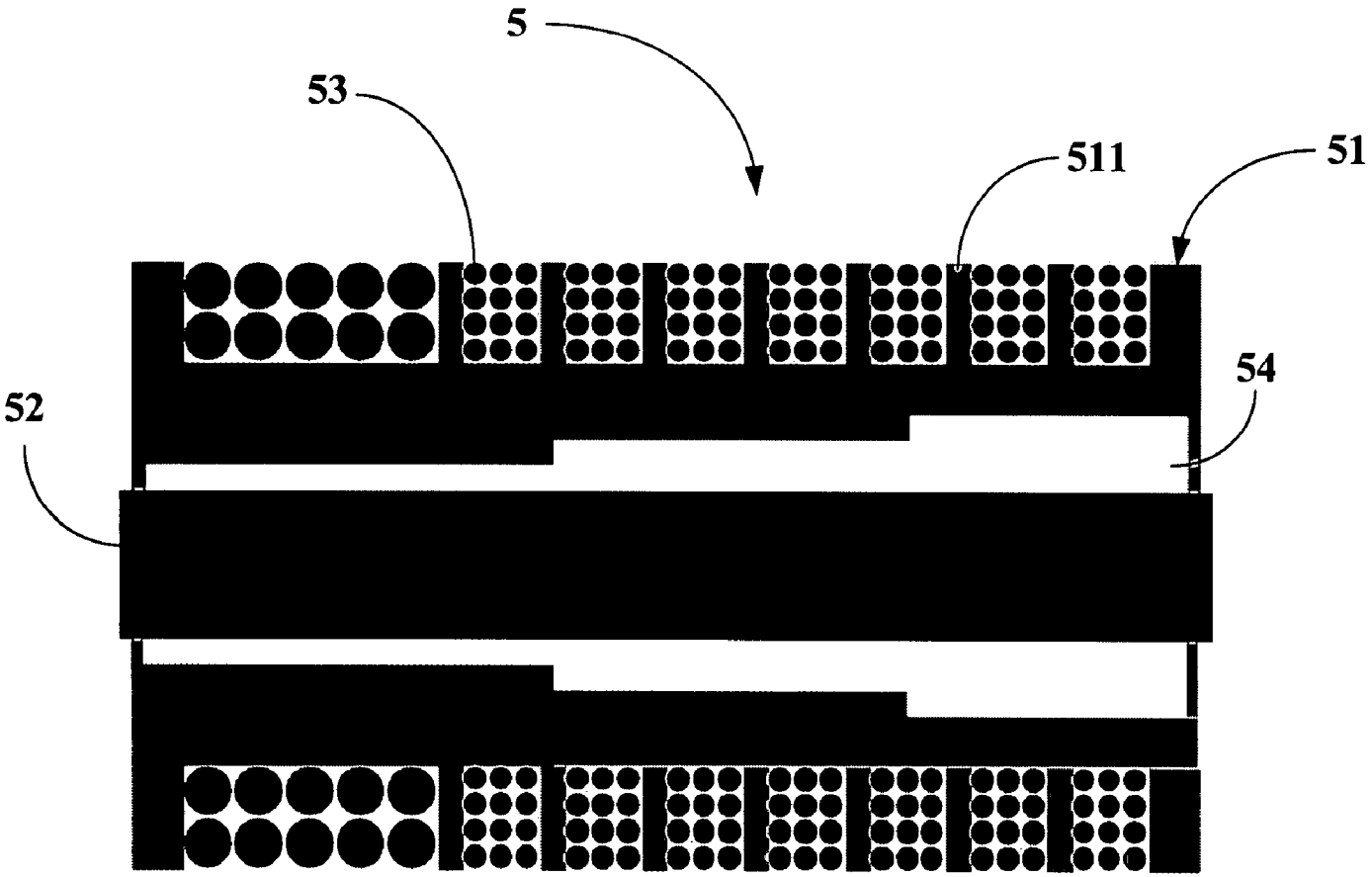
FIG. 5 is a cross sectional view of the choke transformer used in LCD backlight driver according to a fourth embodiment of the present invention.

Referring to FIG. 5, a cross sectional view of the choke transformer used in LCD backlight driver according to a fourth embodiment of the present invention is depicted therein. As shown, the choke transformer 4 is composed of a winding base 51, a core 52 and a plurality of windings 53. On the winding base 51, a plurality of spacers 511 are formed. Between two neighboring ones of the plurality of spacers 511, a portion of the plurality of windings 53 of different characteristics are wound. The winding base 51 has a hollow structure therein and the core 52 is centrally received in the hollow structure, the hollow structure having a progressively varied peripheral length along a length direction of the winding base 51. In this configuration, an air gap 54 is provided between the winding base 51 and the core 52. As such, the choke transformer 5 endurable to a high voltage is formed.

Figure 6:
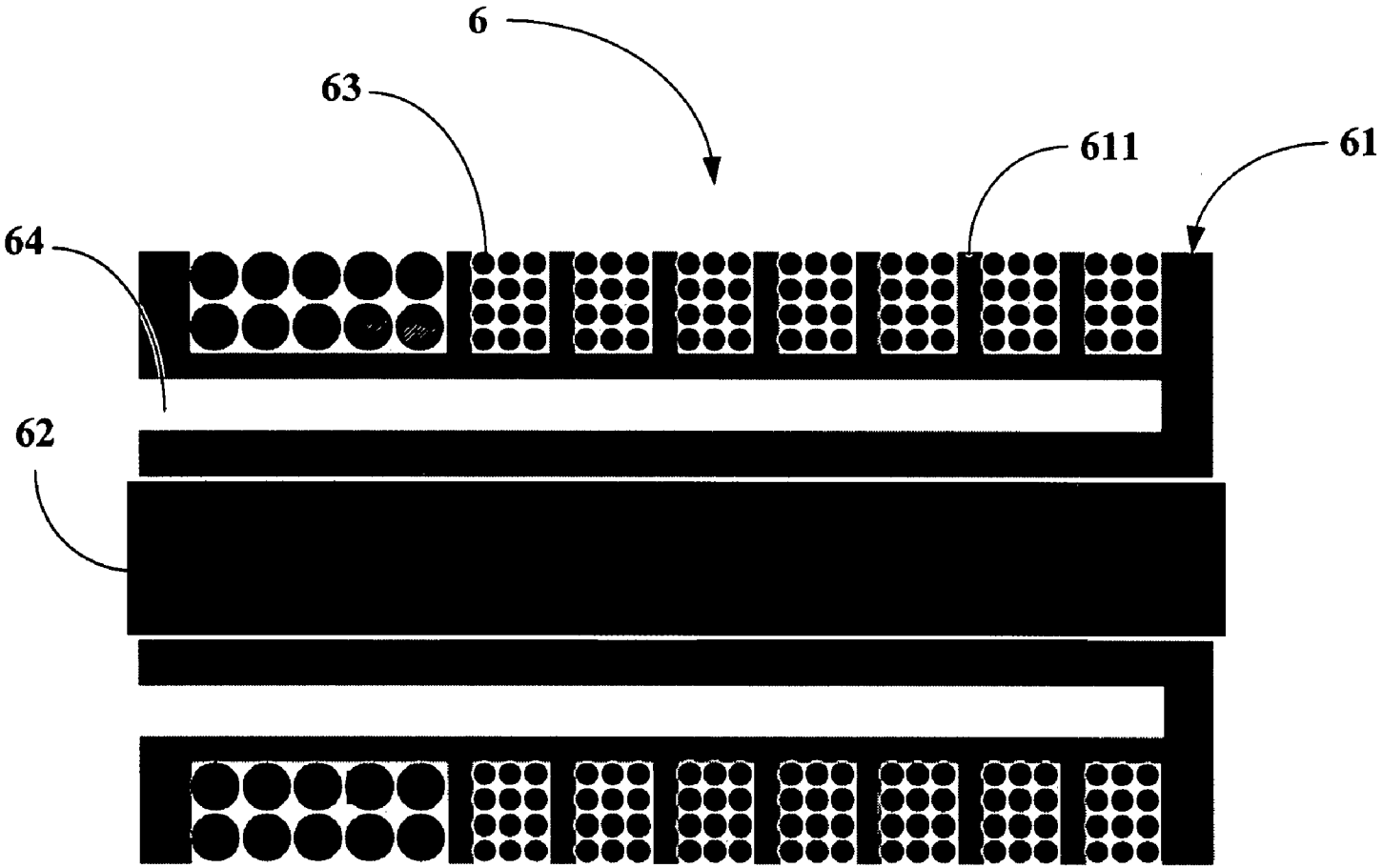
FIG. 6 is a cross sectional view of the choke transformer used in LCD backlight driver according to a sixth embodiment of the present invention.

Referring to FIG. 6, a cross sectional view of the choke transformer used in LCD backlight driver according to a fifth embodiment of the present invention is depicted therein. As shown, the choke transformer 6 is composed of a winding base 61, a core 62 and a plurality of windings 63. On the winding base 61, a plurality of spacers 611 are formed. Between two neighboring ones of the plurality of spacers 611, a portion of the plurality of windings 63 of different characteristics are wound. Within the winding base 61, the core 62 is centrally received. In the winding base 61, two long recesses are provided between the core 62 and a right side and a left side of the choke transformer 6, respectively, and forms two air gaps 64, separating the core 62 and the right side and the left side of the choke transformer 6, respectively. As such, the choke transformer 6 endurable to a high voltage is formed.

As compared to the prior art, the choke transformer of the invention provides at least the following advantages. 1. For a given endurable voltage, amount and cost of the winding base and windings may be relatively reduced. 2. Providing that a same dimension of the components of the choke transformer is given, a higher endurable voltage may be achieved. 3. Characteristics of higher endurable voltage, prolonged lifetime, reduced cost, reduced dimension and saved installation space may be achieved.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A choke transformer used in liquid crystal display (LCD) backlight driver, the choke transformer comprising a winding base having a hollow structure and on which a plurality of spacers are formed, a core received within the hollow structure of the winding base;

and a plurality of windings among which a winding set formed of a portion of the plurality of windings having different characteristics is wound between two neighboring ones of the plurality spacers, characterized in that a plurality of air gaps of differing widths is provided between the winding base and the core, said air gap widths being defined by said individual characteristics of said windings whereby the choke transformer is provided with a higher endurable voltage associated with the particular windings characteristics in respective areas between said neighboring ones of said plurality of spacers.

2. The choke transformer according to claim 1, wherein the hollow structure is a sectional structure having a front section air gap narrower than a rear section air gap thereof so that the front section air gap is arranged in open communication with said rear section gap.

* * * * *